US006910417B1

(12) United States Patent
Tafel

(10) Patent No.: US 6,910,417 B1
(45) Date of Patent: Jun. 28, 2005

(54) INKING ARRANGEMENT IMPROVEMENT

(76) Inventor: Leonard Immanuel Tafel, 1821 Azalea La., Mt. Prospect, IL (US) 60056

( * ) Notice: Subject to any disclaimer, the term of this patent is extended or adjusted under 35 U.S.C. 154(b) by 0 days.

(21) Appl. No.: 10/894,151

(22) Filed: Jul. 19, 2004

(51) Int. Cl.[7] ..... B41F 31/00

(52) U.S. Cl. ..... 101/351.1; 101/185; 101/352.01; 101/247

(58) Field of Search ..... 101/351.1, 352.01, 101/218, 247, 182, 184, 185, 191, 192, 209, 101/144, 145

(56) References Cited

U.S. PATENT DOCUMENTS

| | | | | |
|---|---|---|---|---|
| 3,814,014 A * | 6/1974 | Dahlgren | 101/137 |
| 4,122,772 A * | 10/1978 | Dahlgren | 101/218 |
| 4,919,047 A * | 4/1990 | Inouye et al. | 101/175 |
| 5,042,377 A * | 8/1991 | Palecek et al. | 101/148 |
| 5,865,116 A * | 2/1999 | Keller et al. | 101/148 |
| 6,272,985 B1 * | 8/2001 | Keller et al. | 101/137 |

* cited by examiner

*Primary Examiner*—Eugene H. Eickholt

(57) ABSTRACT

A mechanism for rotary printing presses to increase the number of ink form-rollers without decreasing the space available for changing the printing plates. An additional advantage of this mechanism is the ease of access to the inner form rollers.

12 Claims, 4 Drawing Sheets

INKING ARRANGEMENT IMPROVEMENT

DESCRIPTION OF RELATED ART

Rotary printing presses are generally divided into four main categories: Flexographic, Rotagravure, Letterpress and Offset. The letterpress and offset press categories are subdivided into so-called "Newspaper" and "Commercial" presses, and other than the quality of materials and workmanship, the main distinction between the two is the number of rollers in the inker, particularly the number of inking rollers contacting the printing plate, referred to as "form rollers". Many current "newspaper" printing presses were originally designed for single color, e.g. black, printing, but through gradual improvements in plates, inks, and blankets, and related technologies, and the expansion of color ads, these presses have evolved into multicolor and process color presses, which compete with commercial press printing at the lower end of the quality spectrum, the primary remaining impediment to higher quality being the quality of the inking arrangement. The usual design of form rollers includes pivoting the form rollers around the closest ink drum to the plate cylinder sufficiently to create a space of approximately one-sixteenth of an inch between the plate cylinder and the form roller for exchanging plates, which is referred to as "throw-off".

Examples of the prior art are listed:

The extreme measures sometimes used to gain access to the inner form rollers is shown is illustrated in Aberle U.S. Pat. No. 2,564,590. Here the entire inker side-frame assembly pivots open.

The Despot U.S. Pat. No. 4,625,642 discloses a system which requires removing several rollers to allow removal of still other rollers to gain access to the interior rollers for servicing as described beginning in the last paragraph of column 3.

The Beisel U.S. Pat. No. 4,711,174 discloses a system having a movable framework supporting all the form rollers which may be pivoted away from the plate cylinder by a combination of eccentrics and pneumatic cylinders. There is limited access for exchanging the plates.

The Kelm U.S. Pat. No. 5,230,284 and Guaraldi U.S. Pat. No. 4,458,591 disclose a system for raising the form rollers off the plate and for maintaining the form roller settings plate cylinder during cocking using a disk means similar to Hermach U.S. Pat. No. 3,366,047.

The Kamoda U.S. Pat. No. 6,109,181 illustrates the complexity involved in bringing out the adjustments of the inner form roller for operator access, and focuses on being able to remove the plate cylinder without resetting the form rollers.

SUMMMARY OF THE INVENTION

The present mechanism provides a simple means of improving the performance of a rotary printing press through the addition of one or two ink form rollers, and at least one ink transfer drum in such a manner as to retain access for plating, while maintaining roller surface contact with the rest of the inker. An additional advantage of the present mechanism is the ease of access to the inner form rollers.

DETAILED DESCRIPTION OF THE INVENTION

The present invention relates to an improved ink form-roller positioning apparatus wherein the form-roller is moved into its non-operating position in such a manner as to permit ease of access for the operator to replace the printing plate and to adjust the inner form-roller. Inking surface contact is retained at all times with the rest of the inking rollers to facilitate cleanup, and so that when the subject form-roller is moved into its operating position in contact with the printing plate, there may already be a proper supply of ink on the roller, thus minimizing the number of rotations of the press before usable copies are produced. Adding additional roll elements to an inker in any position will improve printing quality. If these additional roll elements include a form roller the improvement is amplified. If an ink drum is added as is the case of the preferred embodiment, it may optionally be a self-oscillating roller of commercially available design, to further improve the quality of inking. The ink drum supplying the first form roller may contact the middle form roller instead of the top transfer roller as shown. However, it is preferred that a separated ink supply for the first form roller be used so that the last two rollers are reserved solely for smoothing of the ink.

Whereas the present illustrations show a typical web-offset press, it will be understood that the present apparatus may be applied to sheet-fed presses and to letter presses, as well as offset presses of various configurations and manufacture, and that whereas the preferred embodiment uses the normal throw-off shaft arrangement, other means, including pneumatic cylinders may be used interchangeably. The present invention may be applied to new press designs, as well as being retrofitted in the field into existing presses.

Figure 1:
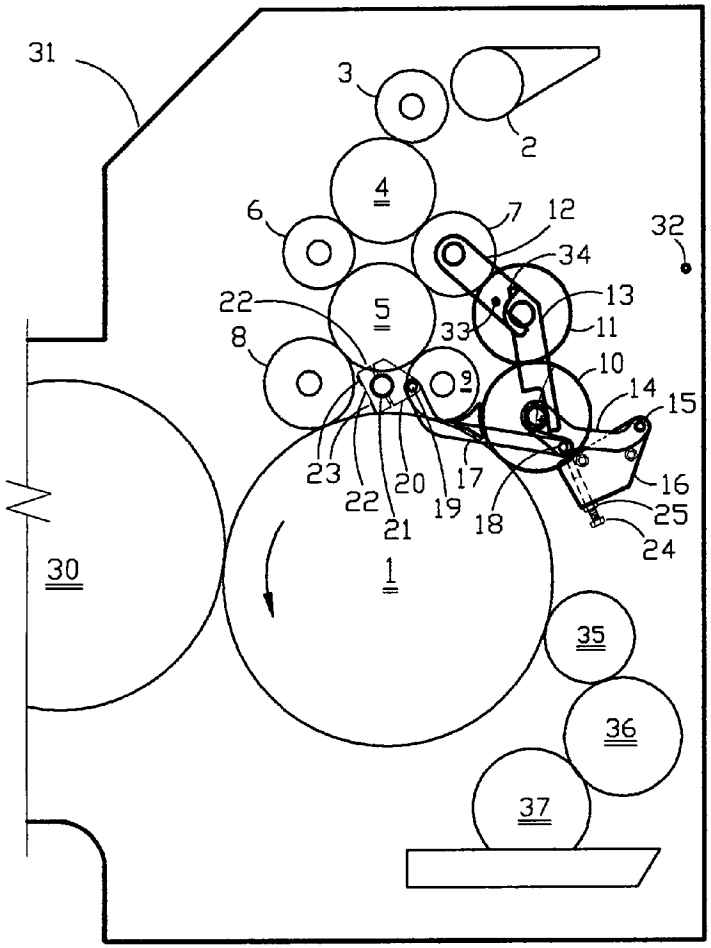
FIG. 1 is a diagrammatic, partial operators-side elevation view of a typical web-offset printing press, showing a typical inking unit in the normal operating condition, augmented according to the invention.

FIG. 1 is a diagrammatic, partial operators-side elevation view of the preferred embodiment incorporated into a typical web-offset newspaper printing press. The view illustrates the form roller throw-off mechanisms which are mounted against each of the spaced frames 31 near each end of plate cylinder 1. A mode one is defined as the normal operating condition wherein the form rollers contact the printing plate, and transfer ink thereto. In mode two, all the form rollers are moved into a non-contacting position with respect to the printing plate wherein the ink is not transferred and which also allows the printing plates to be exchanged. Throw-off, or movement from a mode one to mode two, is achieved in the by counterclockwise rotation of throw-off shaft 21 which is connected by linkage or cam mechanisms to each of the form rollers. The throw-off shaft extends between the frames, and is rotated manually by the press operator, or preferably rotated by customary pneumatic means. Ink is supplied from an ink reservoir 2 through a speed matching roller 3, to a first oscillating inking drum 4 and through transfer rollers 6 and 7 to a second oscillating ink drum 5 and thence to customary ink form-rollers 8 and 9. Dampener form roller 35, dampener drum 36 and water pan 37, blanket cylinder 30, and idler roller 41 are also shown for reference to demonstrate the limited space available for exchanging printing plates. All of the preceding elements are of conventional design. This design is shown augmented according to the invention with ink form roller 10, and ink drum 11 and their supporting structures 13 and 12 respectively. Adjusting screws on each of paired adjusting and supporting structures 12 and 13 set the contact pressure between transfer roller 7 and ink drum 11, and between said ink drum and form roller 10 respectively. Form roller 10 is adjusted to the printing plate by slightly loosening paired bolts 23 which clamp cap 22 to throwoff lever 20, adjusting stop screw 24 to achieve the desired contact pressure, loosening said adjusting stop screw one half turn, retightening bolts 23, retightening said adjusting stop screw one half turn and tightening jam nut 25.

Figure 2:
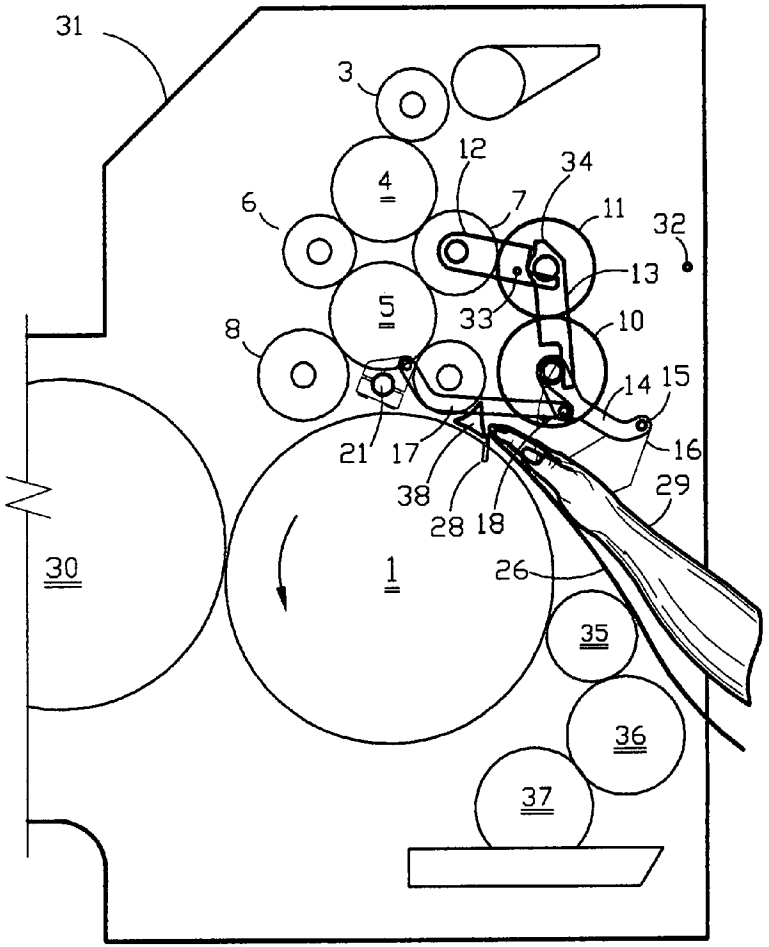
FIG. 2 illustrates FIG. 1 but with the ink form-rollers moved away from the plate cylinder to allow for exchanging plates according to the invention.

FIG. 2 illustrates the view in FIG. 1 but in mode two with the customary ink form-rollers 8 and 9 moved slightly away from the plate cylinder to allow for exchanging plates. Also shown in mode two is third ink form roller 10 which has been moved into a spaced relation with the plate cylinder, and ink drum 11 which has moved contiguously, collectively and in unison with ink form roller 10. The throw-off shaft 21 has been rotated a fraction of a revolution, and its associated linkage or cam mechanisms have acted collectively and in unison to move the form rollers into mode two. Ink drum 11 is maintained in contact with transfer roller 7 and third form roller 10, said form roller having been moved into a spaced relationship with the plate cylinder to permit operator access for exchanging printing plates.

The counterclockwise rotation of the throw-off shaft 21 has caused paired throw-off levers 20 which are clamped to each end of said throw-off shaft by pairs of caps 22 which are each attached by a pair of bolts 23 to said throw-off levers which act through rotatible pins 19, to push paired actuator links 17, which act on paired pins 18, thereby rotating paired pivot arms 14 clockwise about pin 15 located in pivot block 16, and moving form roller 10, which is supported thereby, to a spaced position from said plate cylinder. Rollers 3–11 remain in contact so that ink will be immediately available to the printing plate when the form-rollers are moved to the operating position. An operators hand 28 is shown inserting a printing plate 26 into plate slot 27 to illustrate how adequate space is made available for operator's fingers beneath the additional third form roller 10. Finger guard 38, of customary design, spans the space between the frames, and is typically removable for exchanging rollers.

Figure 3:
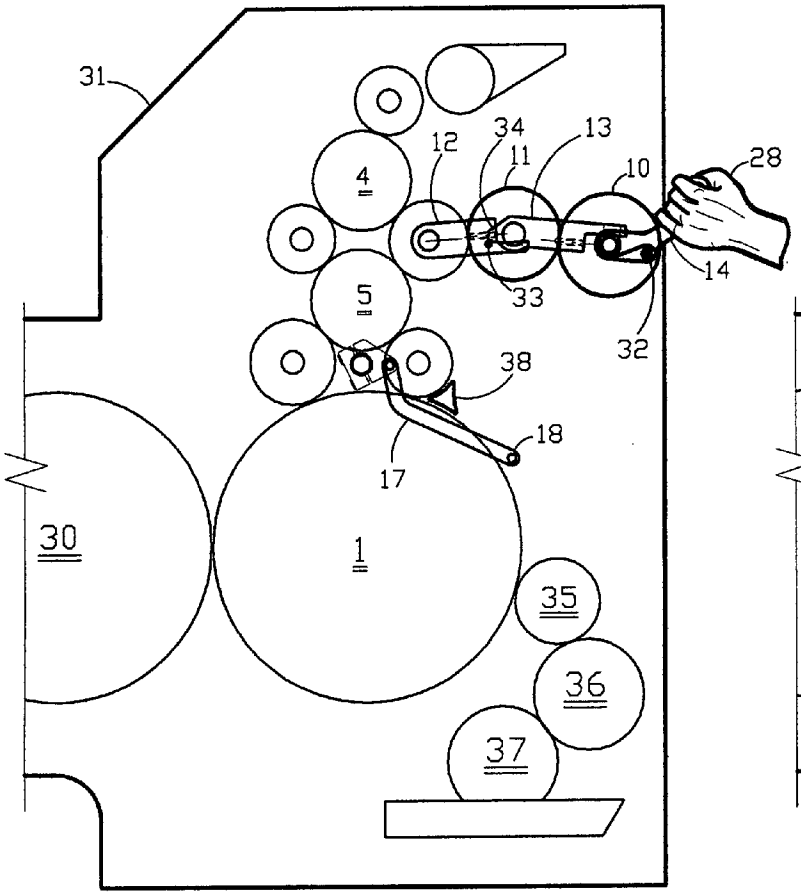
FIG. 3 illustrates FIG. 1 with the ink form-rollers pivoted entirely away from the plate cylinder to allow access to the interior adjustments according to the invention.

FIG. 3 is a diagrammatic, partial, operators-side elevation view of a web-offset printing press, showing an inking unit in mode three, wherein the ink form-rollers are manually pivoted entirely away from the plate cylinder to allow access to the interior adjustments and servicing of form roller 9. The operator's hand 29 grasps and moves pivot arms 14 inward from the frames 31 sufficiently to disengage pins 13 and then pulls said pivot arms outward sufficiently to engage pins 31 which are located in the press frames, with the holes in said pivot arms normally occupied by pin 18. The entire added assembly, including rollers 10 and 11 and their adjustable supporting structures 12–14, are thereby maintained in a wide open position so as to provide easy operator access. It will be understood that operative rotation means of support structures 12 and 13 may be operatively-accomplished automatically by pneumatic cylinders or similar operative means. This is not shown as the preferable embodiment because of the expense and complexity to accomplish what is infrequently required.

Figure 4:
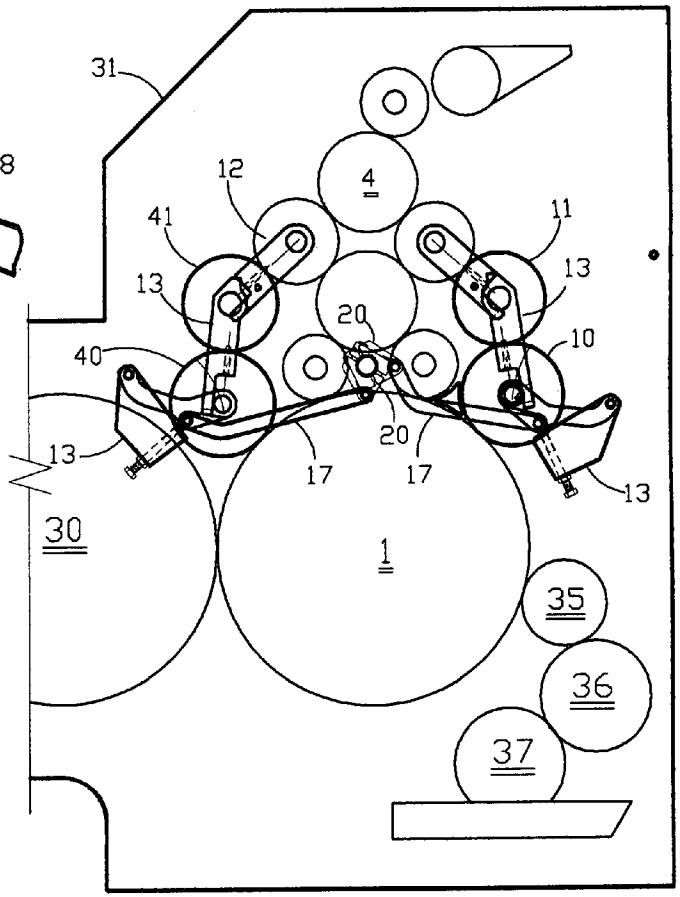
FIG. 4 is a diagrammatic, partial operators-side elevation view of a typical web-offset printing press in mode one, showing an inking unit augmented with two additional form rollers.

FIG. 4 is a diagrammatic, partial operators-side elevation view of the invention incorporated into a typical web-offset newspaper printing press wherein a first ink form roller 10 and a first ink drum 11, and also a second ink form roller 40 and a second ink drum 39 are added. In this example of the invention, the throwoff motion illustrated in FIG. 2 is needed to move the form roller moves in a path essentially radially outward from the plate cylinder to provide adequate access for adjustment of the inner form roller and also for access to the adjoining blanket cylinder.

Figure 5:
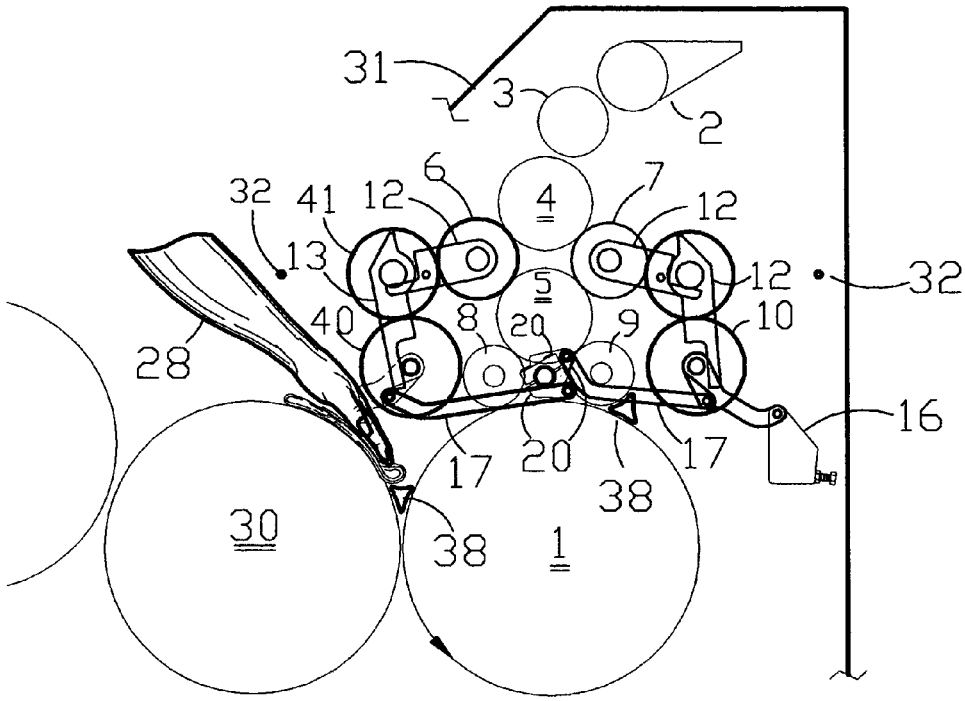
FIG. 5 is a view of a FIG. 4 shown in mode two, illustrating the access which is provided for blanket cleaning and replacement according to the invention.

FIG. 5 is a view of a FIG. 4 above shown in mode two, illustrating the access which is provided by moving the form roller 40 at least an inch away from the plate and blanket cylinders according to the invention, for blanket cleaning and replacement. An operator's arm 28 is shown cleaning the offset blanket on blanket cylinder 30 with a rag. Similarly, adequate space is also made available for operator's fingers beneath form roller 10. Finger guard 38, of customary design, spans the space between the frames.

Figure 6:
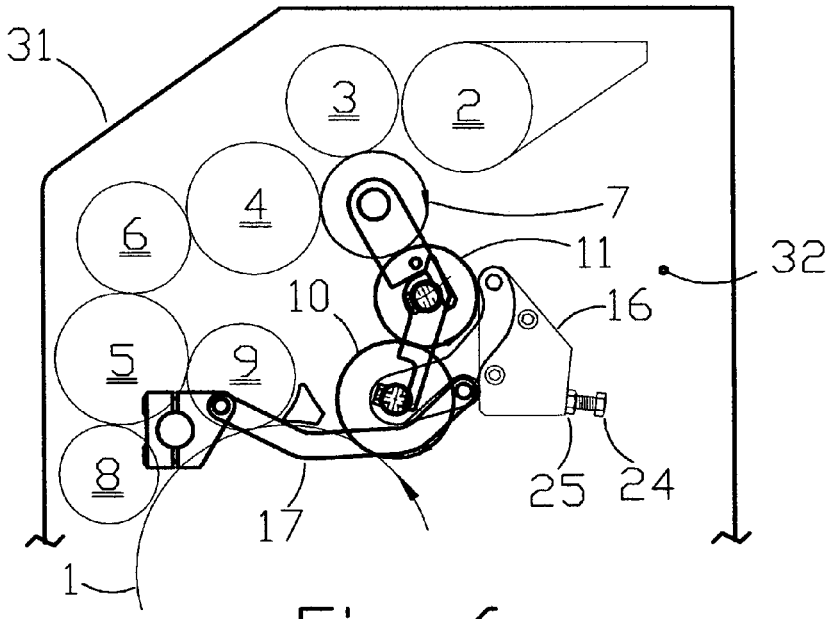
FIG. 6 is a diagrammatic, partial operators-side elevation view of another typical web-offset printing press, showing a different inking arrangement in mode one, augmented according to the invention.

FIG. 6 is a diagrammatic, partial operators-side elevation view of the preferred embodiment incorporated into a typical web-offset newspaper printing press of a design differing from the one illustrated in FIG. 1, in that the ink from the speed-matching roller 3 delivers the ink first to roller 7, and thence to the sequence of rollers which feed ink to the last two form rollers 8 and 9. This arrangement is often considered advantageous in that the ink is transferred to the plate primarily by the first form roller, reserving the next two rollers to principally smooth the ink already applied.

Figure 7:
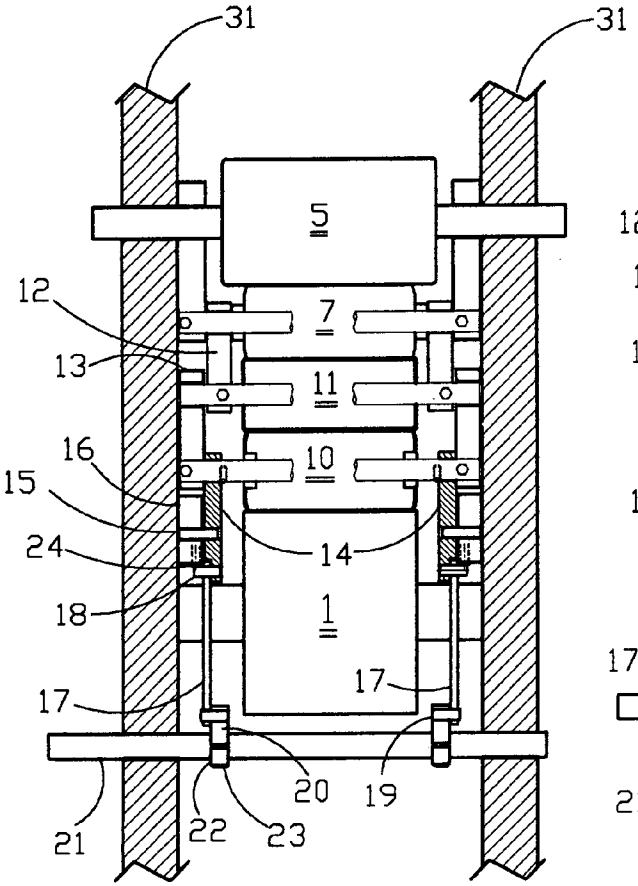
FIG. 7 is a plan view of FIG. 1.

FIG. 7 is a diagrammatic, sectional, partial plan view of FIG. 1 which particularly illustrates spaced frames 31, paired supporting structures 12 and 13, paired pivot arms 14, paired throw-off links 17 and paired throw-off levers 20.

Figure 8:
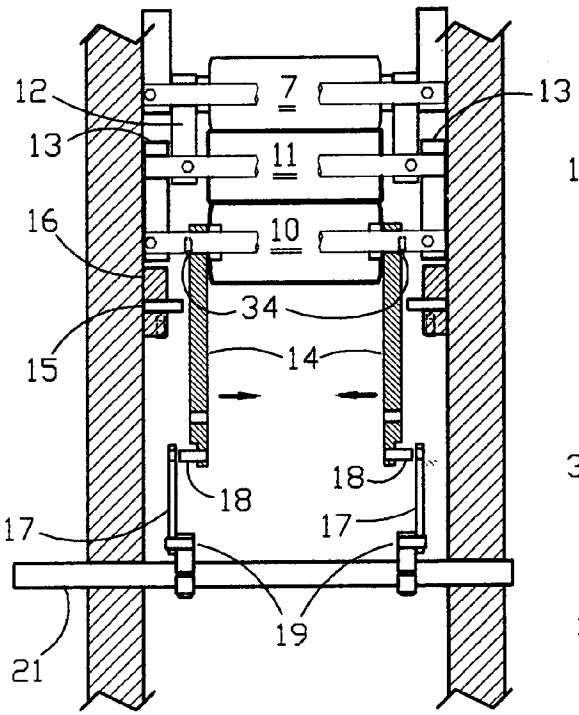
FIG. 8 is a plan view of FIG. 3, showing the additional form-roller positioning mechanism wherein the pivot arms are moved away from the frame by the operator.

FIG. 8 is a diagrammatic, sectional, partial plan view of FIG. 3, showing the form-roller positioning mechanism being moved from mode two to mode three, wherein the pivot arms are moved away from the frame by the operator, thereby disengaging them from pin 18 located on throwoff link 17.

Figure 9:
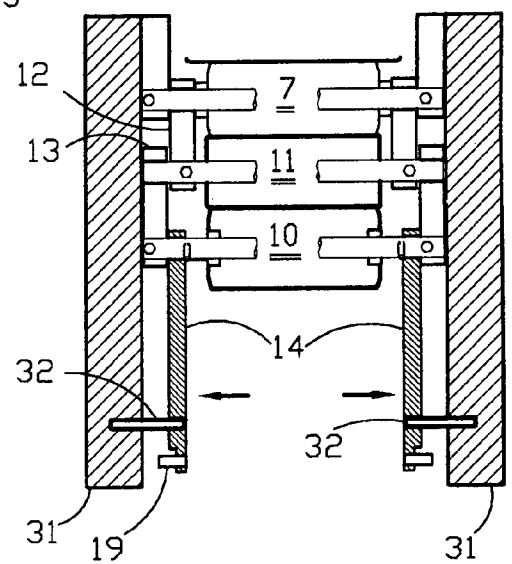
FIG. 9 is a plan view of FIG. 3, showing the additional form-roller positioning mechanism restrained wide open to provide access to the inner form roller.

FIG. 9 is a diagrammatic, sectional, plan view of FIG. 3, showing the additional form-roller positioning mechanism in mode three wherein the operator has moved the hole in the pivot arm previously engaged with pin 18 over a pin 31 protruding from the inside of the press frame thereby retaining the ink drum 11 and the ink form roller 10 together with their paired supporting links 12 and 13 in an extended condition, thereby exposing the inner form roller for servicing and adjustment.

What is claimed is:

1. In a rotary printing press having:

a plate cylinder, an ink supply, an inking roller arrangement of conventional design, and a paper feed means, wherein said inking roller arrangement has at least one oscillating drum, at least one transfer roller and at least one form roller, all supported within a pair of spaced frames, an improvement to said inking roller arrangement consisting essentially of:

at least one additional ink drum which is rotated by friction contact of its circumferential surface with a roll element in said conventional inking roller arrangement and at least one additional form roller, wherein said form roller is rotatibly supported on each end by a first pair of adjustable support structures which are pivotal about the centerline of said additional ink drum, and wherein said pair of first adjustable support structures are adapted to permit operator adjustment of the pressure between the exterior surfaces of said form roller and said ink drum, and wherein said ink drum is rotatibly supported on each end by a second pair of adjustable support structures which are pivotal about the centerline of said ink drum and about the centerline of an inking roll element in said inking roller arrangement, wherein said second pair of adjustable support structures are adapted to permit operator adjustment of the pressure between the exterior surfaces of said ink drum and said inking roll element, and a means to constrain the centerline of rotation of said ink form roller to move in a predetermined path parallel to the frame, and a pair of connecting links acting on each end of said form roller, and a selectively operable throw-off mechanism acting in unison and combination with each of said connecting links to move said form roller into contact with the printing plate, or alternatively, to move said form roller into a spaced relationship with said plate cylinder, said spaced relationship being sufficiently large to permit the space formerly occupied by said form roller in its operating position to become available to the printing press operator for manually exchanging printing plates.

2. The improvement to said inking roller arrangement according to claim 1 wherein said inking roll element in said inking roller arrangement is an oscillating drum situated in said inking roller arrangement.

3. The improvement to said inking roller arrangement according to claim 1 wherein said inking roll element in said inking roller arrangement is an ink transfer roller.

4. The improvement to said inking roller arrangement according to claim 1 wherein said inking roll element in said inking roller arrangement is a form roller.

5. The improvement to said inking roller arrangement according to claim 1 wherein said inking roll element in said inking roller arrangement is an inker idler roller.

6. The improvement to said inking roller arrangement according to claim 1 wherein the means to move the centerline of rotation of said form roller in a predetermined path consists of a pair of pivot arms each pivoted on a pivot pin, said pivot arms acting collectively and in unison on each end of the axle of said form roller to define an arcuate path of movement of the centerline of rotation of said form roller.

7. The improvement to said inking roller arrangement according to claim 1 wherein the means to move the centerline of rotation of said form roller in a predetermined path consists of a pair of spaced rails, the contour of said rails engaging the supporting structures on each end of said form roller, thereby defining a predetermined path of said form roller.

8. The improvement to said inking roller arrangement according to claim 1 wherein the ink drum optionally contains a self-oscillating mechanism of commercially available design.

9. The improvement to said inking roller arrangement according to claim 1 wherein the ink form roller optionally contains a self-oscillating mechanism of commercially available design.

10. The improvement to said inking roller arrangement according to claim 1 wherein a plurality of ink drums and rollers are provided.

11. The improvement to said inking roller arrangement according to claim 1, wherein the operator may disengage the throw-off connecting elements, thereby permitting said form roller and said ink drum to be moved to a spaced position from said plate cylinder as a contiguous assembly, and whereby engaging elements on the ends of said form rollers may temporarily engage and restrain said form roller and said ink drum in said spaced position by a pair of retaining structures, each d to one of said spaced frames, thereby providing easy operator access to otherwise hidden rollers and adjustments.

12. In a rotary offset printing press having: a paper feed means, a plate cylinder, a blanket cylinder, an ink supply, and an inking roller arrangement of conventional design, wherein said inking roller arrangement has at least one oscillating drum, at least one transfer roller and at least two form rollers, all supported within a pair of spaced frames, an improvement to said inking roller arrangement essentially comprised of:

an additional ink drum provided with a self-oscillating mechanism of commercially available design which is rotated by friction contact of its circumferential surface with a transfer roller in said inking roller arrangement, and an additional form roller which is rotated by friction contact of its circumferential surface with said ink drum, wherein said form roller is rotatibly supported on each end by a first pair of adjustable support structures, pivotal about the centerline of said additional ink drum, and wherein said pair of first adjustable support structures are adapted to permit operator adjustment of the pressure between the exterior surfaces of said form roller and said ink drum, and wherein said ink drum is rotatibly supported on each end by a second pair of adjustable support structures which are pivotal about the ink drum centerline and about the transfer roller centerline, and wherein said second pair of adjustable support structures are adapted to permit operator adjustment of the pressure between the exterior surfaces of said ink drum and said inking roll element, and a pair of pivot arms each pivoted on a pivot pin, said pivot arms acting collectively and in unison on each end of the axle of said form roller to define an arcuate path of movement of the centerline of rotation of said form roller, and a pair of connecting links acting on each end of said form roller, and a selectively operable throw-off mechanism acting in unison and combination with each of said connecting links to move said form roller into contact with the printing plate, or alternatively, to move said form roller into a spaced relationship with said plate cylinder, wherein said spaced relationship is sufficiently large to permit the space formerly occupied by said form roller in its operating position to become available to the printing press operator for manually exchanging printing plates, and wherein the operator may disengage the throw-off connecting elements, thereby permitting said form roller and said ink drum to be moved to a spaced position from said inking arrangement and said plate cylinder as a contiguous assembly, and a pair of retaining structures, each attached to one of said spaced frames, and engaging elements on each end of said form roller which may temporarily engage said retaining structures and restrain the form roller and ink drum assembly in a spaced and open position which provides easy operator access to otherwise hidden rollers and adjustments.

* * * * *